US005724678A

United States Patent [19]

McCallum et al.

[11] Patent Number: 5,724,678

[45] Date of Patent: Mar. 10, 1998

[54] HAT WITH STORAGE POCKET

[76] Inventors: Timothy P. McCallum, 6717 Neptune Pl., San Diego, Calif. 92037-5921; Frank C. Del Pizzo, Jr., 1505 Villa Chase Ct., Marietta, Ga. 30068

[21] Appl. No.: 578,989

[22] Filed: Dec. 27, 1995

[51] Int. Cl.[6] ..... A42B 1/04

[52] U.S. Cl. ..... 2/209.13; 2/181; 2/195.1

[58] Field of Search ..... 2/171, 171.1, 175.1, 2/181, 181.2, 195.1, 209.13

[56] References Cited

U.S. PATENT DOCUMENTS

| | | | |
|---|---|---|---|
| 1,172,927 | 2/1916 | Bloch . | |
| 1,422,435 | 7/1922 | Gooding . | |
| 1,575,130 | 3/1926 | Schiff . | |
| 2,597,447 | 5/1952 | Bruns | 43/11 |
| 2,615,168 | 10/1952 | Tannenbaum . | |
| 3,285,307 | 11/1966 | Dormaier | 150/1 |
| 4,165,542 | 8/1979 | McLaughlin | 2/209.1 |
| 4,312,076 | 1/1982 | Gamm | 2/199 |
| 4,317,238 | 3/1982 | Amin | 2/12 |
| 4,386,437 | 6/1983 | Fosher | 2/199 |
| 4,451,935 | 6/1984 | Henschel | 2/199 |
| 4,472,837 | 9/1984 | Saxton | 2/199 |
| 4,610,038 | 9/1986 | Dennard | 2/209.1 |
| 4,630,317 | 12/1986 | Brown et al. | 2/12 |
| 4,899,887 | 2/1990 | Cachero | 206/579 |
| 5,070,545 | 12/1991 | Tapia | 2/195 |
| 5,173,970 | 12/1992 | Shifrin | 2/410 |
| 5,214,802 | 6/1993 | McCallum | 2/196 |
| 5,367,713 | 11/1994 | McCallum | 2/209.12 |
| 5,459,881 | 10/1995 | Fagan et al. | 2/209 |
| 5,477,629 | 12/1995 | Gleason, Jr. | 40/329 |

FOREIGN PATENT DOCUMENTS

| | | |
|---|---|---|
| 1472626 | 1/1967 | France . |
| 139374 | 3/1920 | United Kingdom . |

*Primary Examiner*—Diana Biefeld

*Attorney, Agent, or Firm*—Brown, Martin, Haller & McClain, LLP

[57] ABSTRACT

A hat has a storage pocket on the inside of the hat which is located entirely within a dead space at the front portion of the hat extending from a location spaced above a hat band towards the crown of the hat. When a hat is worn, there will be a dead space inside the hat where the hat does not contact the wearer's head, which typically extends from a location just above the hat band to the crown of the hat, due to the difference in curvature between the wearer's head and the hat itself. By positioning a storage pocket in this area, unsightly bulges are avoided, as well as discomfort due to stored items pressing against the wearer's head.

11 Claims, 2 Drawing Sheets

HAT WITH STORAGE POCKET

BACKGROUND OF THE INVENTION

The present invention relates generally to hats, and is particularly concerned with a hat having a storage space or pocket for storage purposes.

Hats with pockets are known. For example, U.S. Pat. No. 4,165,542 of McLaughlin describes a hat with a pocket on the inside into which the hat can be inserted for easy carrying when not in use. The pocket has a lower end at the rim of the hat and an upper end adjacent the crown. When the hat is worn, small items may be inserted for carrying purposes. However, since the lower end of the pocket is at the rim of the hat, such items will fall down to the rim, where they will bear against the wearer's head and may cause some discomfort. In U.S. Pat. No. 5,214,802 of McCallum, a convertible hat and bag assembly is described, which has two layers, one of which acts as a hat when it is outermost and the other of which acts as a bag when outermost. An opening in one layer provides access to the space between the two layers for storage purposes. However, items stored in this space will fall down to the rim area when the assembly is worn as a hat, causing discomfort and also bulges which may detract from the appearance of the hat.

SUMMARY OF THE INVENTION

It is an object of the present invention to provide a new and improved hat with a storage pocket.

According to the present invention, a hat is provided which comprises a head covering member having a headband for encircling the head of a wearer, an outer face, an inner face, a crown, a front portion, a rear portion, and opposite side portions, a pocket secured to the inner face of the head covering member, the pocket having an access opening spaced above the headband and being located in the front portion of the head covering member, the pocket extending from the access opening upwardly towards the crown of the head covering member so that at least the majority of the pocket is located in a dead space of the hat which will not contact the wearer's head when the hat is worn, and a releasable fastener mechanism for releasably closing the pocket opening.

When a hat is worn on a wearer's head, the hat will not be in contact with the head over its entire area. Typically, the hatband or sweatband contacts around the periphery of the head, but due to the difference in curvature between the person's forehead and the front portion of the hat, there will be a dead space between the hat and forehead, extending from a location just above the sweatband or hatband up to the crown of the head. According to this invention, a pocket is positioned within this dead space so that items placed in the pocket do not bear against the wearer's head and cause discomfort. Also, items in the pocket will not cause bulges on the outside of the hat, and will therefore not detract from its appearance.

Preferably, a pull tab is secured to the pocket adjacent the opening, for pulling by a user to easily open the pocket. The releasable closure mechanism may comprise mating strips of hook and loop type fastener material such as VELCRO® on opposite sides of the pocket opening, or may alternatively comprise a zipper, snap fasteners, or the like.

The head covering member may comprise a single layer or an outer layer and an inner layer. The inner layer may be of mesh or other cool, lightweight material, and may extend only over the front portion of the hat or over the entire outer layer of the hat. Where the hat covering member is a single layer, the pocket may be releasably or permanently secured to the inside of the hat layer. Where an inner layer is provided, the pocket may be secured between the two layers with an opening in the inner layer around which the opening in the pocket is secured. The inner layer may be releasably secured to the hat so that it may be removed for use as a clutch bag or the like separate from the hat. In the latter case, the inner layer is preferably secured around its periphery to the outer layer via mating strips of hook and loop type fastener material, such as VELCRO®. Waist straps may be provided for releasably securing to the removed inner layer so that it may be used as a waist pack or the like. The waist straps are preferably provided with mating fastener material for mating with the same strip of fastener material which would otherwise be used for securing the inner layer to the outer layer of the hat. Thus, if something is to be carried which is too large for the pocket, the entire inner layer of the hat may be removed for use as a clutch or waist pack.

Preferably, where the pocket is secured to a separate inner layer or liner of the hat, the liner is secured to the crown of the hat via a button or the like extending through both layers of the cap. This will act to hold the pocket up and prevent sagging, and will also hold the contents of the pocket away from the head to avoid discomfort.

The pocket opening has a width substantially equal to the width of the front portion of the hat and preferably does not extend over the sides of the hat. Preferably, the depth of the pocket is such that it extends up to the crown or just past the crown of the hat. The pocket may be of waterproof material or may have a waterproof insert for items which may be damaged by moisture. The pocket may be formed entirely separately from the head covering member, or the single layer or inner layer may form an inner wall of the pocket, with the outer wall of the pocket sewn around its periphery apart from the opening to the underlying hat layer or liner layer.

The hat with a storage pocket allows small items such as money, keys, credit cards and the like to be stored conveniently when walking, running, surfing or the like. The positioning of the pocket is such that the stored items will not bear against the wearer's head and cause discomfort, since they are located in a dead space of the hat where it does not contact the wearer's head. Also due to the pocket positioning, the stored items will not cause any bulges on the outside of the hat which could otherwise detract from its appearance.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 1:
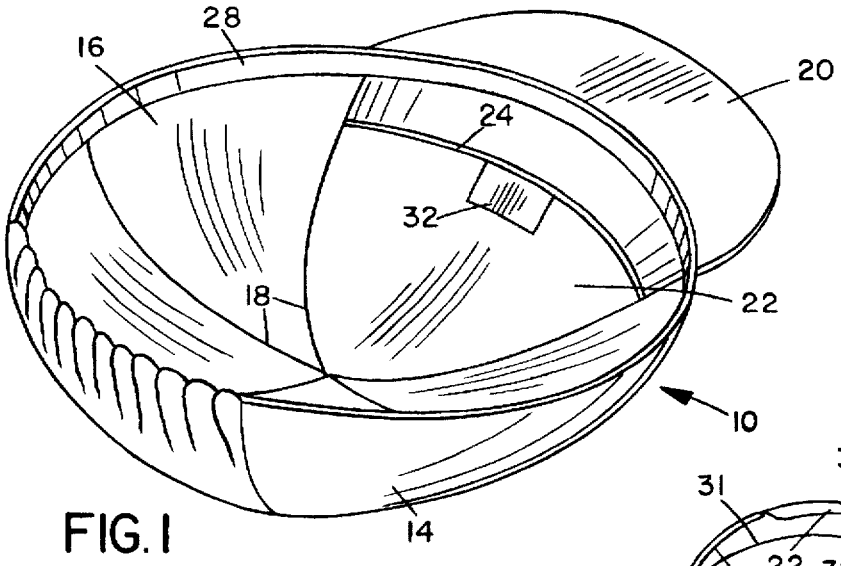
FIG. 1 is a perspective view of a hat with a built-in storage pocket according to a first embodiment of the invention.
Figure 2:
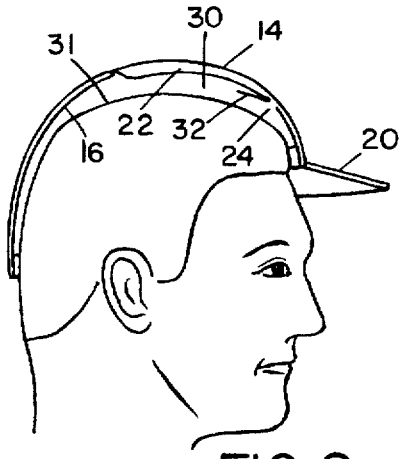
FIG. 2 is a side elevation, partially in section, illustrating the positioning of the hat of FIG. 1 on a wearer's head.
Figure 3:
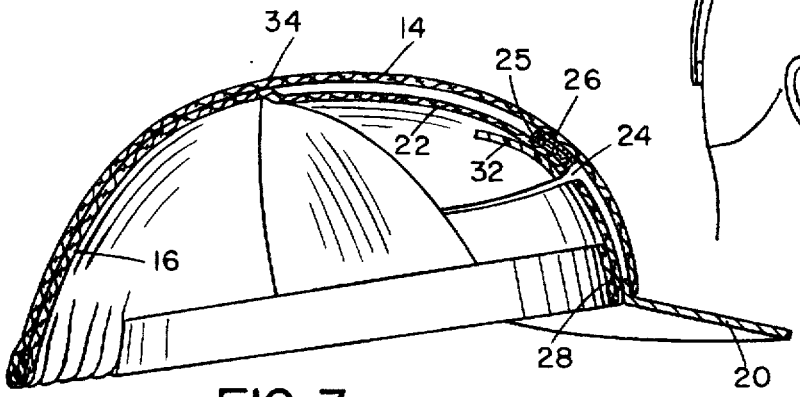
FIG. 3 is a section on the lines 3—3 of FIG. 1.

FIGS. 1 to 3 of the drawings illustrate a hat or cap 10 according to a first embodiment of the invention which has an integral pocket 22. Hat 10 has an outer layer 14 and an inner layer or liner 16 which is sewn to the outer layer along the periphery of the hat and also seams 18 dividing the interior of the hat into generally triangular segments, as best illustrated in FIG. 1. A brim or bill 20 is secured along a forward edge of the hat in a conventional manner so as to project outwardly from a wearer's head as generally illustrated in FIG. 2. Pocket or storage space 22 is formed between the outer layer 14 and liner 16 in a forward triangular segment of the hat, with an access opening 24 provided in liner layer 16 to provide access to pocket 22. The adjacent seams 18 define the periphery of the pocket. Thus, portions of the outer layer 14 and liner layer 16 within seams 18 define an outer layer and an inner layer, respectively, of the pocket 22. The inner and outer layers will also be sewn together along one edge of opening 24, as illustrated in FIG. 3, so that the pocket does not extend down to sweatband 28. A suitable fastener device is provided for releasably closing pocket opening 24, such as a zipper, snap fasteners, or the like. In the preferred embodiment, opposing strips 25,26 of mating hook and loop type fastener material, such as VELCRO® are provided along opposing edges of opening 24, as best illustrated in FIG. 3.

As illustrated in FIGS. 1 and 2, opening 24 is spaced above hat sweatband 28. When the hat is worn, there will be a dead space 30 between the hat and the wearer's forehead, due to the difference in curvature between the hat and the wearer's head. The pocket 22 is appropriately positioned so that it will be substantially completely located within the dead space 30 when the hat is worn, as illustrated in FIG. 2. By locating the pocket in this position, items placed in the pocket will not bear against the wearer's head, avoiding potential discomfort. Also, items in the pocket will not cause bulges on the outside of the hat, which could potentially detract from the appearance of the hat.

The pocket 22 in FIGS. 1 to 3 has a downwardly facing opening. However, the pocket may alternatively be provided with an upwardly facing opening adjacent the crown of the hat, with an appropriate seam being provided at the location of opening 24 in FIG. 1 to define the lowermost portion of the pocket and ensure that items do not fall down to the headband or sweatband 28.

A pull tab 32 is secured to the liner layer adjacent the pocket opening 24, as best illustrated in FIGS. 1 and 2, to enable the user to open the pocket more easily. Seams 18 secure the liner layer to the outer layer of the hat up to the button or crown 34, ensuring that the pocket is held up and does not slip down against the wearer's head due to the weight of items in the pocket. Alternatively a separate pocket 22 may be secured to an opening in a liner layer which is not secured to the outer layer along seams 18, but only along the periphery of the hat, for example. In this case, the liner layer may be additionally secured to the outer hat layer at the button or crown 34, for example by stitching or the like.

Figure 5:
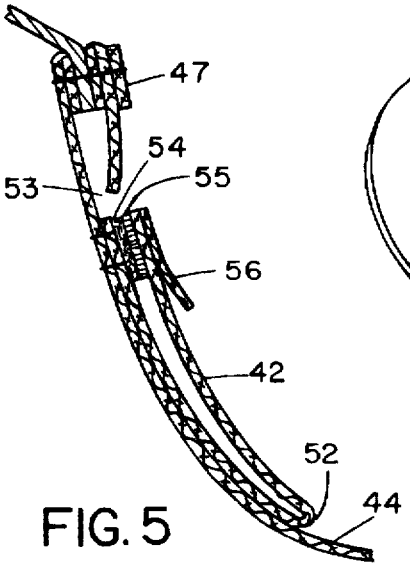
FIG. 5 is a section through a front portion of the hat on the lines 5—5 of FIG. 4.
Figure 4:
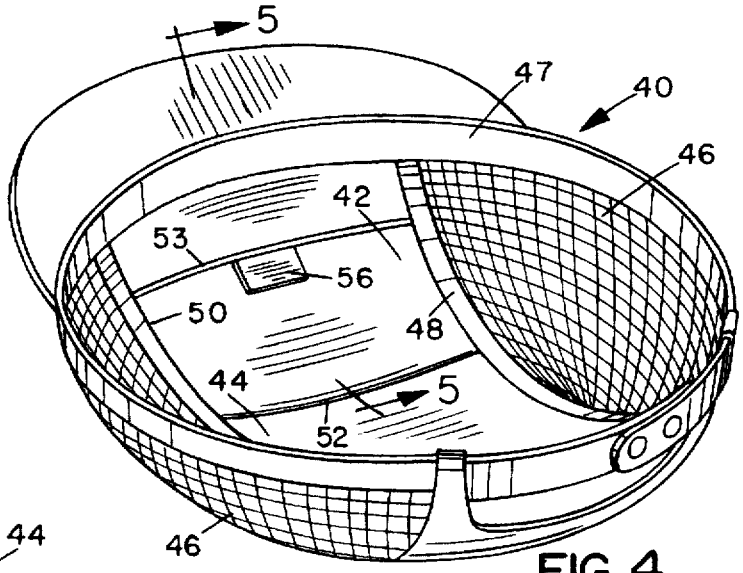
FIG. 4 is a perspective view of a hat with a pocket according to a second embodiment of the invention.

FIGS. 4 and 5 illustrate an alternative, single layer hat 40 with a pocket 42, according to a second embodiment of the invention. Single layer hats are often used by participants in sporting activities such as running or cycling. This type of hat will be much cooler and is therefore preferable to the double layer hat of the first embodiment when performing sporting or other arduous activities.

Hat 40 has a central, solid panel 44 of a suitable material such as cotton, and two side panels 46 of mesh material to allow air flow and cooling of the wearer's head. Alternatively, panels 46 may also be of a solid material with no openings. A conventional sweat band 47 is sewn around the peripheral edge of the hat. Pocket 42 is made from a separate piece of material which is folded in half and is sewn along two side seams 48,50 to the solid panel 44 at a location spaced above sweat band 47. As best illustrated in FIG. 5, the folded pocket 42 forms an inner layer adjacent hat panel 44 and an outer layer spaced outwardly from panel 44. Pocket 42 has a closed end or fold 52 adjacent the crown of the hat and an opening 53 facing downwardly towards the sweatband. A suitable releasable fastener mechanism is provided for closing opening 53, such as a zipper, snap fasteners or the like, or opposing strips 54,55 of mating hook and loop type fastener material, such as VELCRO®, as best illustrated in FIG. 5. As in the previous embodiment, a pull tab or handle tab 56 is provided for allowing the pocket to be readily opened.

As in the previous embodiment, pocket 42 is located within the dead space of the hat, so that it will be positioned away from the wearer's head as the hat is worn, and items in the pocket will not cause the wearer any discomfort, nor detract from the outer appearance of the hat.

Instead of forming pocket 42 entirely from a separate piece of material as illustrated in FIGS. 4 and 5, panel 44 may form one side of the pocket and a single piece of material may be sewn along three sides to panel 44 to form the other side of the pocket, in an equivalent position to pocket 42 in FIGS. 4 and 5. Additionally, the pocket may be reversed if desired, with the opening 53 located along edge 52 and the closed end of the pocket being positioned adjacent sweat band 47.

Figure 6:
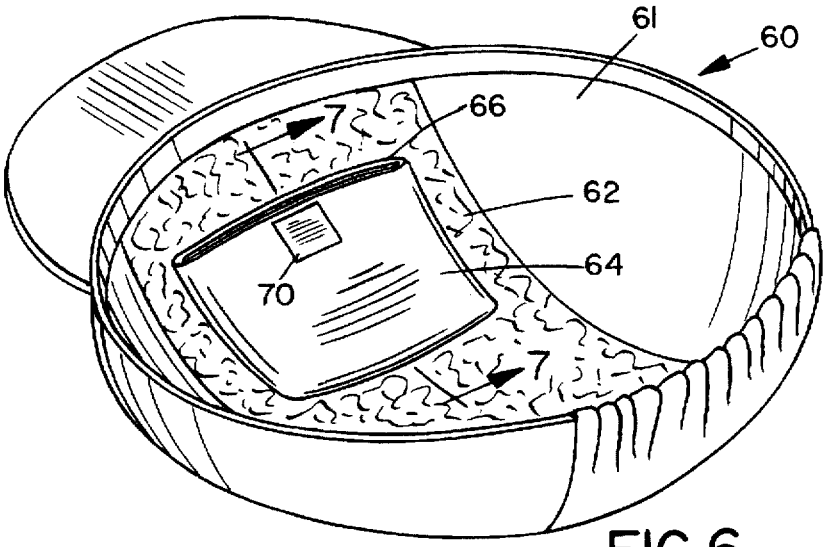
FIG. 6 is a perspective view of a hat with an attached pocket according to a third embodiment of the invention.
Figure 7:
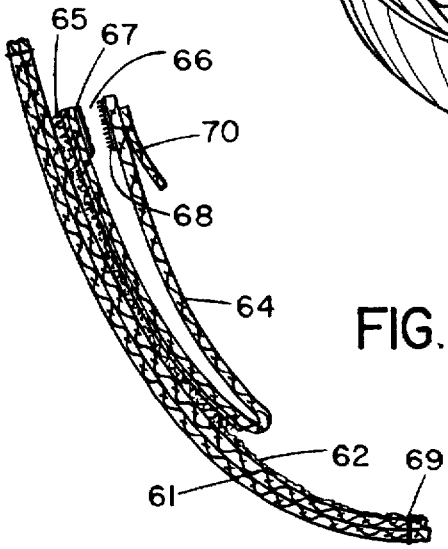
FIG. 7 is a section through the front of the hat on the lines 7—7 of FIG. 6.

FIGS. 6 and 7 illustrate another alternative embodiment of the invention in which a hat 60 of the same general style as the previous embodiments has an outer layer 61 and a partial liner layer 62 of nylon tricot loop material. Layer 62 may extend over the entire inner surface of the hat, if desired, or may be provided as a tape or strip sewn along the hat seams. Nylon tricot loop material is soft enough to form a liner layer for a hat, but will releasably adhere to hook-type fastener material such as VELCRO® while being softer and more flexible than conventional loop-type fastener material such as VELCRO®.

A separate pocket 64 is provided with a layer 65 of hook-type fastener material secured to one face of the pocket. Pocket 64 has an inner layer adjacent liner 62 which is covered with the hook type material layer 65, and an outer layer spaced outwardly from the inner layer, as best illustrated in FIG. 7. Pocket 64 has an opening 66 releasably closed by opposing strips 67,68 of hook and loop material, as in the previous embodiments, or may alternatively be closed by a zipper, snap fasteners, or the like. The pocket layer 65 is simply pressed against the layer 62 so that the hook and loop formations releasably adhere to one another to secure the pocket on the inside of the hat. The layer 62 may be additionally secured to the hat at the crown or button by stitching 69, or alternatively by riveting or the like, so that the weight of the pocket and contents do not cause the hat to sag. A pull tab 70 may be provided for easy opening of pocket 64, as in the previous embodiments.

With this arrangement, the pocket may be removed from the hat when desired to insert items into the pocket or remove items from the pocket, or when the pocket is to be carried by hand, and may then be readily re-adhered to the inside of the hat when the hat is to be worn. The loop material liner layer may be partial or extend over the entire hat, or just along the hat seams, but must permit the pocket to be adhered to the hat so as to be located in the dead space when the hat is worn, as in the previous embodiments.

Figure 9:
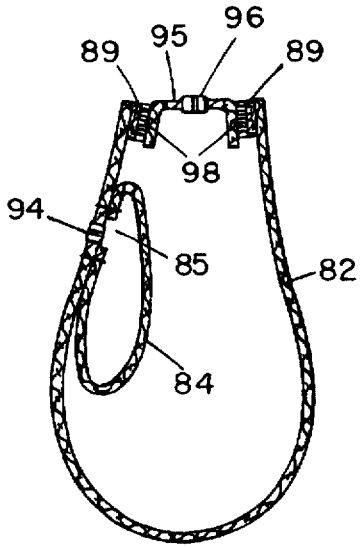
FIG. 9 illustrates the liner of FIG. 8 removed from the hat and reversed to provide a bag.
Figure 8:
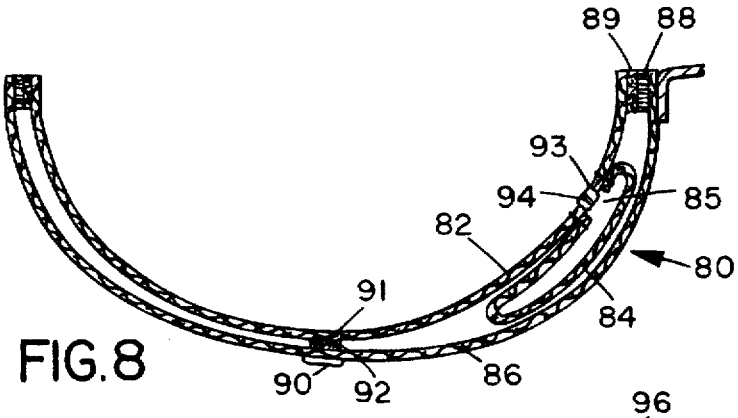
FIG. 8 is a sectional view similar to FIG. 3 illustrating a hat and pocket according to a fourth embodiment of the invention.
Figure 10:
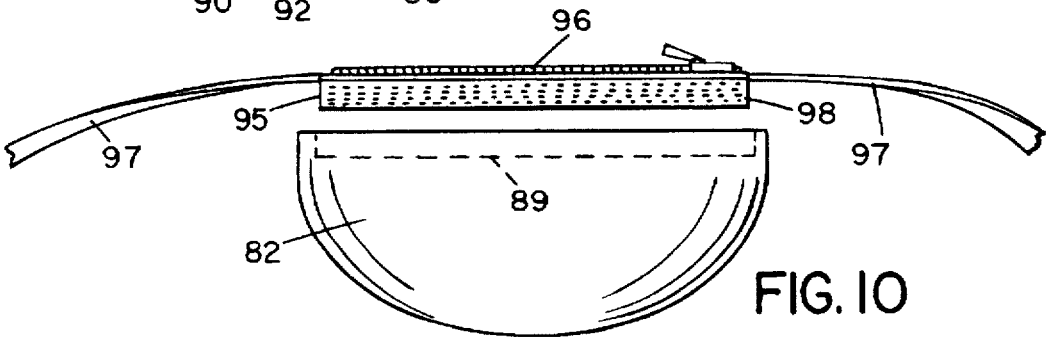
FIG. 10 is a perspective view of the bag of FIG. 9 with a closure member and waist straps attached.

FIGS. 8 to 10 illustrate another alternative embodiment in which hat 80 has a removable liner layer 82 having a pocket 84. Liner layer 82 is releasably secured around the periphery of the outer hat layer 86 by suitable strips 88,89 of mating, hook and loop type material extending around the inner periphery of outer layer 86 and the outer periphery of liner layer 82, as illustrated in FIG. 8. The layer 82 is preferably also releasably secured to the outer layer 86 at the crown or button 90 by a releasable snap fastener or by mating patches 91,92 of hook and loop fastener material.

Liner layer 82 is provided with a slot or slit-like opening 93 positioned at an equivalent location to opening 24 in the first embodiment, and the pocket 84 has an opening 85 which is suitably sewn around the periphery of opening 24. Pocket 84 may be closed by a zipper 94 or other releasable fastener, or may have opposing strips of hook and loop type fastener material as in the previous embodiments. As illustrated in FIG. 8, the pocket will be located in the dead space of the hat. Slumping of the pocket and liner layer may be reduced by releasably securing the liner layer to the crown of the hat, ensuring that the pocket and its contents remain within the dead space.

The liner layer 82 may be removed from the hat if desired and may then be carried as a clutch bag. Alternatively, the liner layer may be removed from the hat, and turned inside out as in FIG. 9 so that the hook type strip faces inwardly, and the pocket opening 85 faces outwardly. A closure or fastener strip 95 is provided for releasably closing the opening of the reversed liner layer 82, as best illustrated in FIGS. 9 and 10. Closure strip 95 has a central, elongate region having a slit opening closable by means of a zipper fastener 96 extending along the opening, and waist straps 97 extending from the central region for enabling the bag to be secured around a wearer's waist. Flaps 98 of loop type fastener material are secured along opposite sides of the central region of strip 95, for mating with opposing portions of the strip 89 extending along the rim of the reversed liner layer 82, as illustrated in FIG. 9. Thus, the closure strip 95 can be used to close the opening formed when liner layer 82 is reversed and opposing portions of the peripheral edge of liner layer 82 are urged towards each other to form a bag. Zipper fastener 96 then provides access to the interior of the bag, while fastener 94 on the outside of the resultant bag still provides access to the smaller pocket.

This arrangement is particularly convenient since it allows the hat to be worn while smaller items are stored in pocket 84 as well as alternatively allowing the removable liner layer and pocket to be separated from the hat and used as a separate bag for storing larger item's, while the hat can still be worn without the liner layer.

The pocket of this invention may be formed by portions of the existing hat outer and liner layers, where a hat has a separate liner layer, simply by appropriately sewing the outer and liner layers together to form three sides of the pocket and providing an opening in the liner layer for access to the pocket. One example of this alternative is illustrated in FIGS. 1 to 3. Alternatively a separate pocket layer may be sewn between the outer and liner layers in an equivalent location. In this case, the liner layer is preferably permanently or releasably secured to the button or crown of the outer layer, to help prevent the pocket and liner layer from slumping down onto the wearer's head due to heavy items in the pocket.

If the hat is of single layer construction, a separate pocket may be suitably secured to the inner surface of the hat at an appropriate position, or may be releasably secured to the inner surface as in FIGS. 6 and 7. The inner surface of the hat may form one side of the pocket, with a single piece of material sewn to the inner surface to form the other side of the pocket, if desired, or the pocket may be formed by a single piece of material folded and sewn along two sides to the hat, as in FIGS. 4 and 5. If desired, the pocket may have a waterproof liner layer so that the contents of the pocket can be kept dry in all weather conditions, and also can be protected from sweat. A waterproof liner is particularly desirable for pockets installed in runner's or cyclists hats, for example, or for hats used in water sports such as yachting and windsurfing. In the latter case, the bill of the hat may be of suitable foam material for flotation purposes.

In each case, the pocket is positioned in the so-called "dead space" of the hat, which extends from a position just above a wearer's eyebrows over the entire crown of the head. Typically, when a hat or cap is worn, it will grip around the periphery of the wearer's head along the hat band or sweat band. However, due to the difference in curvature between the wearer's head and the hat, as noted above, there will be a space between the wearer's head and the hat in locations above the sweatband. The pocket may extend from a location spaced above the sweatband up to a location close to the top or crown of the hat, and may be confined to the forward portion of the hat, as in the above embodiments. Alternatively, a larger pocket may be provided in an equivalent manner which extends across the entire top of the hat from the front to the rear and around the sides of the hat, with all portions of the pocket suitably spaced above the sweatband. By positioning the pocket in the dead space, the looks of the hat will not be affected by items placed in the pocket, and the wearer will not experience any discomfort since the pocket contents are held away from the head.

In all cases, the pocket is preferably closed by easily releasable, mating strips of hook and loop type material, such as VELCRO®, and a pull tab may be secured to the rim of the pocket to allow the user to open the pocket readily. Other fasteners such as zippers may alternatively be used.

Although some preferred embodiments of the invention have been described above by way of example only, it will be understood by those skilled in the field that modifications may be made to the disclosed embodiments without departing from the scope of the invention, which is defined by the appended claims.

I claim:

1. A hat, comprising:

a head covering member shaped for forming a hat for covering part of the head of a wearer and having a first peripheral edge defining a head receiving opening, a front portion, a rear portion, opposite side portions and a crown for covering the crown of a wearer's head, the head covering member having an outer face and an inner face;

a pocket located at the inner face of the head covering member, the pocket extending from a location spaced above the peripheral edge in the front portion of the head covering member upwardly towards the crown, whereby at least the majority of the pocket is located entirely within a dead space of the head covering member which is designed to be above a wearer's eyebrows and not contact the wearer's head when the hat is worn, the pocket having an access opening;

a releasable fastener for releasably closing the pocket opening; and the pocket having an outer layer, an inner layer, and a pull tab secured to the outer layer adjacent the access opening whereby a user may pull said pull tab to release the fastener and open the pocket opening.

2. The hat as claimed in claim 1, including first and second strips of fastener material secured to the outer layer and inner layer of the pocket, respectively, adjacent the access opening so as to face one another, one of said strips comprising hook type fastener material and the other strip comprising loop type fastener material for releasable mating engagement with said hook type fastener material.

3. The hat as claimed in claim 1, wherein the pocket is generally triangular in shape.

4. The hat as claimed in claim 3, wherein the apex of the pocket is located adjacent the crown of the hat.

5. The hat as claimed in claim 4, wherein the apex of the pocket is secured to the crown of the hat.

6. The hat as claimed in claim 1, wherein the head covering member includes an outer layer having a surface area defining said hat shape, and an inner liner layer secured to the outer layer, the liner layer extending over at least part of the outer layer, said pocket is formed separately from said head covering member, and said pocket and liner layer include interengagable fastener means for releasably securing said pocket to said liner layer.

7. The hat as claimed in claim 6, wherein said liner layer is of loop type hook and loop fastener material, and said pocket has an inner layer of hook type fastener material for releasable attachment to said liner layer.

8. The hat as claimed in claim 7 wherein said liner layer is of nylon tricot loop material.

9. The hat as claimed in claim 1, wherein the head covering member comprises a single layer, the pocket has a peripheral edge, and the pocket is secured to the inner face of said head covering layer around at least part of the peripheral edge of said pocket.

10. The hat as claimed in claim 9, wherein the pocket is a separate pocket having opposite sides, a bottom fold, and an upper opening, and is secured to the inner face of said head covering layer by seams extending along said opposite sides.

11. A hat, comprising:

a head covering member shaped for forming a hat for covering part of the head of a wearer and having a first peripheral edge defining a head receiving opening, a front portion, a rear portion, opposite side portions and a crown for covering the crown of a wearer's head, the head covering member having an outer face and an inner face;

a pocket located at the inner face of the head covering member, the pocket extending from a location spaced above the peripheral edge in the front portion of the head covering member upwardly towards the crown, whereby at least the majority of the pocket is located entirely within a dead space of the head covering member which is designed to be above a wearer's eyebrows and not contact the wearer's head when the hat is worn, the pocket having an access opening;

a releasable fastener for releasably closing the pocket opening; and the head covering member including an outer layer and a separate inner liner layer secured to the outer layer, the liner layer having an opening at a location spaced above said peripheral edge defining said pocket access opening, and said inner and outer layers being secured together along seams extending from said opening to form said pocket.

* * * * *